US005685403A

United States Patent [19]

Morszeck

[11] Patent Number: 5,685,403

[45] Date of Patent: Nov. 11, 1997

[54] METAL SUITCASE AND METHOD FOR MANUFACTURING A METAL SUITCASE

[75] Inventor: Dieter Morszeck, Cologne, Germany

[73] Assignee: Rimowa Kofferfabrik GmbH, Cologne, Germany

[21] Appl. No.: 424,263

[22] PCT Filed: Oct. 19, 1993

[86] PCT No.: PCT/EP93/02885

§ 371 Date: Jun. 13, 1995

§ 102(e) Date: Jun. 13, 1995

[87] PCT Pub. No.: WO94/08484

PCT Pub. Date: Apr. 28, 1994

[30] Foreign Application Priority Data

Oct. 20, 1992 [DE] Germany ..... 42 35 291.6
Oct. 29, 1992 [DE] Germany ..... 42 36 573.2

[51] Int. Cl.[6] ..... A45C 13/04

[52] U.S. Cl. ..... 190/126; 220/421

[58] Field of Search ..... 150/124, 126, 150/127; 220/4.21, 4.02, 3.96

[56] References Cited

U.S. PATENT DOCUMENTS 2,227,266 12/1940 Levin ..... 190/126 X
2,950,792 8/1960 Axtell ..... 190/124
4,374,555 2/1983 March ..... 190/127
4,433,760 2/1984 Pelavin ..... 190/126 X
4,503,955 3/1985 Fitzsimmons, Jr. ..... 190/124 X

*Primary Examiner*—Allan N. Shoap
*Assistant Examiner*—Christopher J. McDonald
*Attorney, Agent, or Firm*—Malina & Wolson

[57] ABSTRACT

In a metal suitcase (1) consisting of two suitcase halves (2, 4), each having a broad side (**6*a*,6*b*), two opposing narrow sides (8*a*, 8*b*), an upper side (10*a*, 10*b*) and a standing surface (12*a*, 12*b*). The suitcase halves(2,4), in the closed condition, engaging each other by a frame(22) which extends along the narrow side(8*a*, 8*b*), the upper side (10*a*, 10*b*) and the standing surface(12*a*, 12*b*). The suitcase halves (2,4) are pivotally connected to each other in the standing surface(12*a*, 12*b*). It is provided that each suitcase half(2,4) is formed by two single piece wall elements(14*a*, 14*b*, 16*a*, 16*b*). The first wall element(14*a*, 14*b*) consists of a strip-shaped continuous cast profile having a wall-receiving profile (18) formed to one longitudinal edge and having a frame profile(20,21) formed to the opposite longitudinal edge. The second element (16*a*, 16*b***) consists of a plate-shaped metal sheet.

6 Claims, 5 Drawing Sheets

FIG.8A
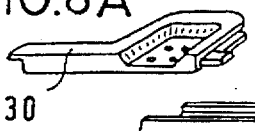
FIG.8B
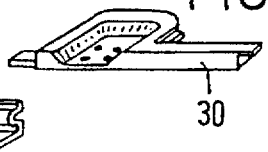
FIG.8C
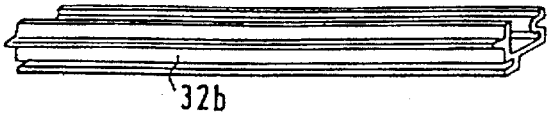
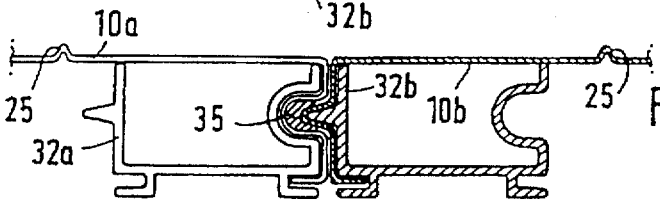
FIG.8D
FIG.7
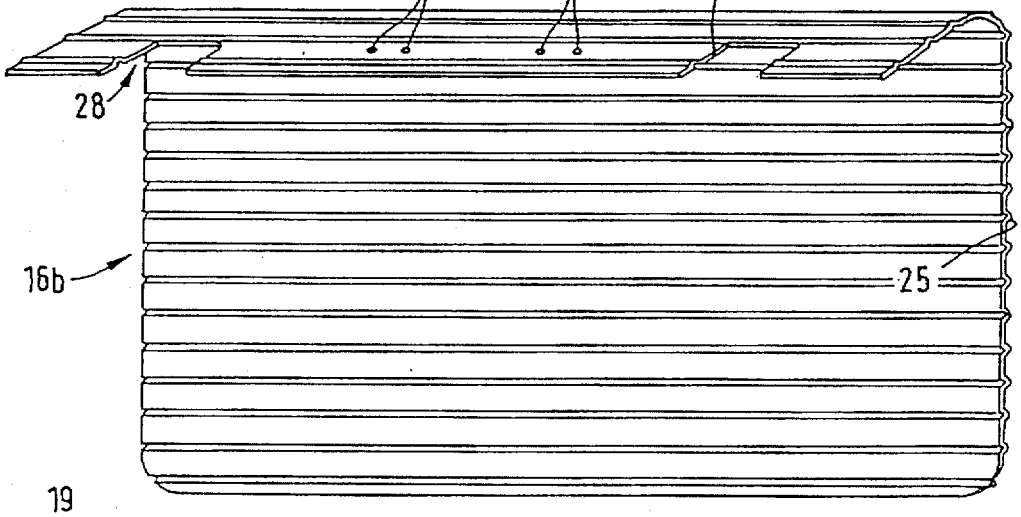
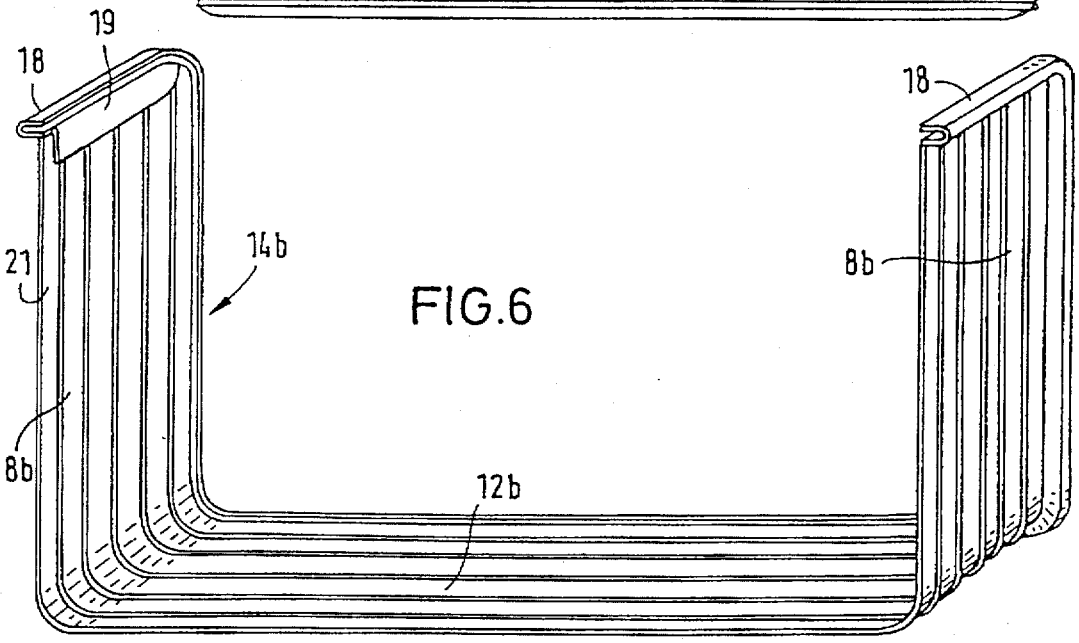
FIG.6

METAL SUITCASE AND METHOD FOR MANUFACTURING A METAL SUITCASE

The invention is directed to a metal suitcase according to the preamble of claim 1 and to a method for manufacturing a metal suitcase according to the preamble of claim 8.

Metal suitcases are known (DE 32 46 510 A 1) which consist of two single-piece shell halves formed, e.g., from a deep-drawn metal sheet. Especially when using high-strength aluminium alloys, such a manufacturing process is very expensive.

Further, it is known to manufacture suitcase shells (DE-PS 835506) from a single-piece metal sheet which is punched out at the corners, with the narrow sides, the upper side and the standing surface being each generated by bending the single-piece metal sheet. For stabilizing purposes and for covering the punching cuts, the bent wall elements have to be connected at the corners to connecting elements which simultaneously serve for protection of the corners. Further, in the separating plane between the suitcase halves, the wall elements are each held by a stabilizing frame member. Also the manufacture of such a suitcase requires high expenditure along with numerous manually performed manufacturing steps.

From DE 16 79 329 U, a method for manufacturing a metal suitcase is known wherein a single-piece wall element is produced from a plate, with the narrow and upper sides being formed by bending the plate once. Another wall element is connected to the above wall element by a double welt.

It is an object of the invention to improve a metal suitcase and a method for the manufacture thereof in a manner allowing for a less expensive and more easily automated production.

According to the invention, the above object is solved by the features of claims 1 and 8, respectively.

As provided by the invention, each suitcase half of the metal suitcase is advantageously formed from two wall elements, of which one wall element consists of a strip-shaped material having one longitudinal edge provided with a wall-receiving profile and having the opposite longitudinal edge provided with a frame profile. The strip-shaped wall element can be manufactured in one manufacturing step from a continuous-cast profile.

A considerable advantage of the invention and the inventive method resides in that the wall elements can be used for suitcases of different sizes by simply cutting the length of the wall elements according to the size of the suitcase. The first wall elements can be delivered, e.g., in the form of coils, and different suitcases can be produced using the same continuous-cast profile.

The above applies also to the second wall element, of which the length can also be cut in accordance to a desired width. Thus, for instance, it is possible to produce the second wall elements of the two suit-case halves—which suitcase halves have different depths—from the same metal sheet. In this manner, the maintenance of stocks of profiles and metal sheets for different sizes of suitcases can be considerably reduced, resulting also in reduced production costs and space requirements.

The second wall element is manufactured, without wall-receiving and frame profiles, from a plane metal sheet and is bent once for forming a broad side of the metal suitcase and the associated upper side.

Assembly of the metal suitcase is performed by simple insertion of the second wall element into the wall-receiving profiles of the first wall element which, for tight interconnection between the wall elements, can be pressed together by a suitable tool.

Preferably, it is provided that the wall-receiving profile along with a flap is punched to project freely at the respective free end of the narrow sides and can be bent, with a transition radius, to the end edge of the narrow sides, with the flap of the wall-receiving profile being fixable to the respective narrow side.

Thus, the suitcase halves of the metal suitcase can be assembled in a simple manner using two single-piece wall elements.

Particularly, the method according to the invention provides:

- producing a first single-piece wall element having a wall-receiving profile formed thereto along one edge thereof, and having a frame profile, made of a strip-shaped continuous-cast profile, formed thereto along the opposite edge,
- punching out an end portion on both ends of the first wall element in such a manner that a wall-receiving profile having a length corresponding to the width of the wall element and being provided with a fastening flap, remains beyond the free end of each of the narrow sides,
- bending the wall-receiving profiles over the free ends of the first wall element,
- connecting the fastening flaps to the free ends of the first wall element,
- bending the first wall element twice for forming the narrow sides and the standing surface,
- producing a second single-piece wall element from a plate,
- forming the broad and upper sides by bending the second wall element once, and
- assembling the first wall elements to the second wall elements, and connecting said wall elements by clamping the wall-receiving profiles together.

Thus, producing each suitcase half requires only one punching process per wall element and a small number of bending processes.

A metal suitcase of the above type can be produced in a small number of manufacturing steps and requires less expenditure for tools. Automation of the individual manufacturing steps is facilitated.

Further embodiments of the invention are contained in the subclaims.

An embodiment of the invention will be explained in greater detail hereunder with reference to the Figures.

Figure 1:
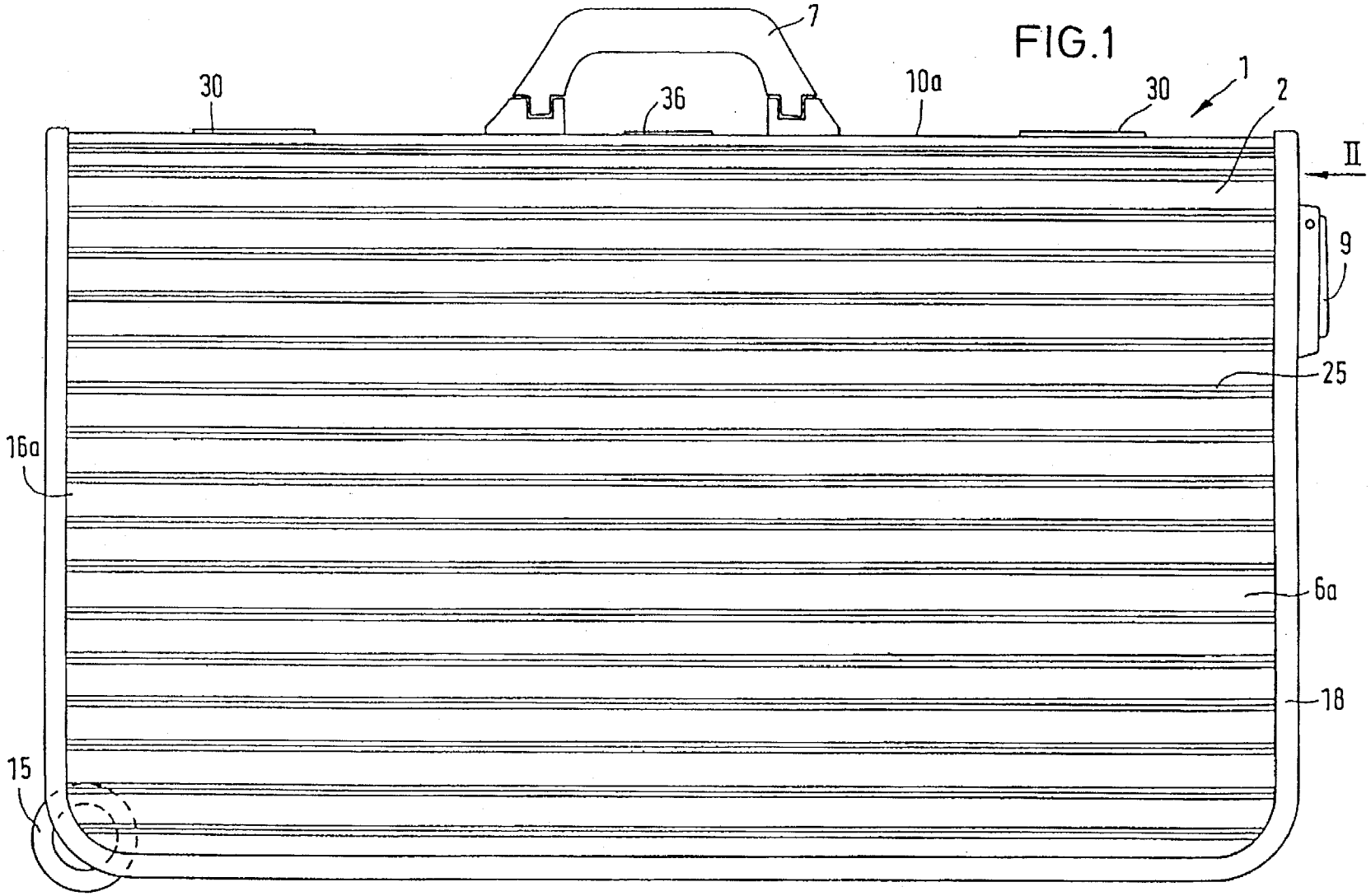
FIG. 1 is a front view of the metal suitcase.
Figure 2:
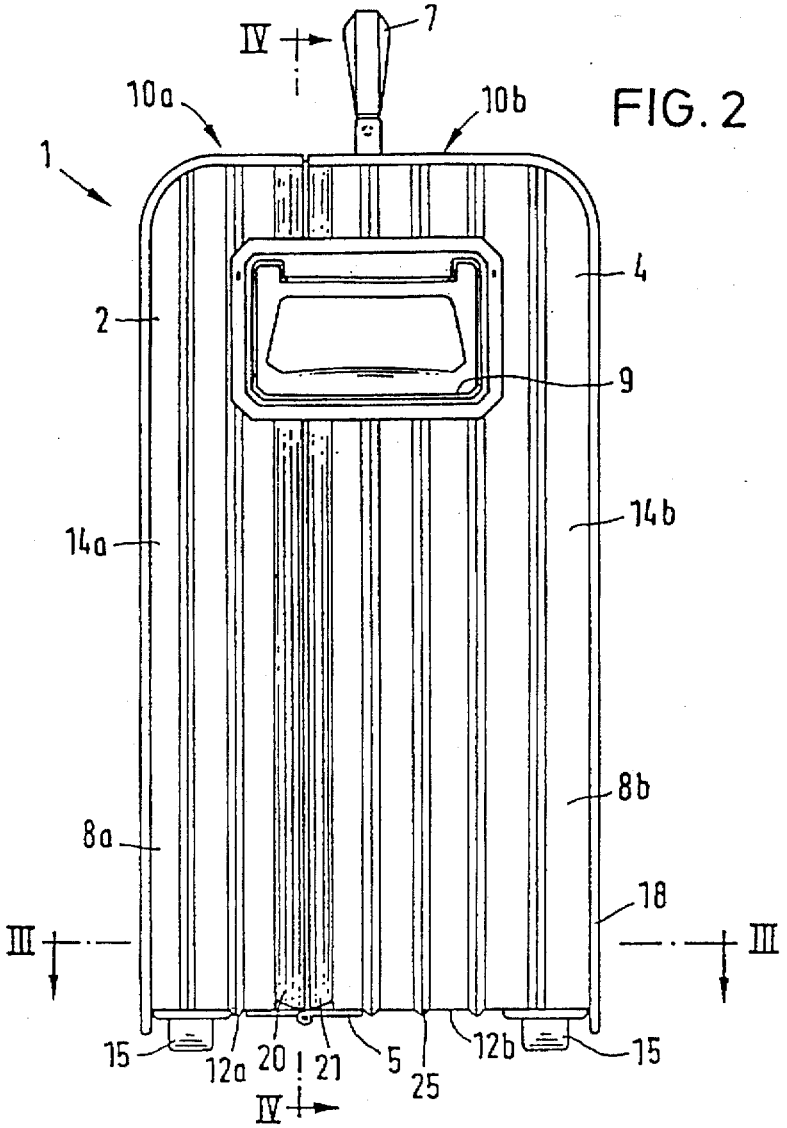
FIG. 2 is side view of the metal suitcase.

FIG. 6 is a view of the wall element of FIG. 5 with bent wall-receiving profile, FIG. 7 is a view of a second wall element, and FIGS. 8*a* to 8*d* are views of frame members for the upper side of one suitcase half of the metal suitcase FIG. 1 shows a metal suitcase 1 consisting of two suitcase halves 2,4 which respectively comprise a broad side 6*a*,6*b*, an upper side 10*a*,10*b*, a standing surface 12*a*,12*b* and two opposite narrow sides 8*a*,8*b*. At a central location of the metal suitcase 1, the upper side 10*b* is provided with a handle 7 for carrying the suitcase, while one of the narrow sides 8a,8b is provided with a further handle 9 for rolling the suitcase, arranged at the upper end of narrow side 8a,8b. The standing surface 12a,12b is provided, at its end facing away from handle 9, with two rollers 15 on which the suitcase, while lifted up on one side, can be rolled using handle 9.

The two suitcase halves 2,4 are asymmetrical, i.e. their respective depths differ from each other. At the standing surface 12a,12b, the suitcase halves 2,4 are connected to each other by one or a plurality of hinges 5 extending along standing surface 12a, 12b, with one hinge member being fixedly connected to standing surface 12a and the other hinge member being fixedly connected to standing surface 12b.

The broad side 6a and the upper side 10a of suitcase half 2 and the broad side 6b and the upper side 10b of second suitcase half 4 are each made from a single piece plate which can be provided with a rib-shaped profile 25 having both a stiffening function and an aesthetic function. This plate forms a second wall element 16 which can be inserted in bent shape into the wall-receiving profile 18 of first wall element 14a,14b. In this regard, it is possible to insert an inflexible plate which is bent once by means of a pressing tool for forming the broad and upper side, respectively, or a flexible plate which is bent during assembly of the two wall elements 14,16 without the need of a previous separate bending process.

The mutually opposite narrow sides 8a,8b and the standing surfaces 12a,12b are formed from two strip-shaped wall elements 14a,14b of different widths, each of them having a longitudinal edge provided with a wall-receiving profile 18 for receiving the second wall element 16a,16b and having its longitudinal edge opposite the wall-receiving profile 18 provided with a frame profile 20 and 21, respectively.

The frame profiles 20,21 of wall elements 14a,14b are adapted to each other such a manner that they engage each other upon assembly of suitcase halves 2,4 and, assisted by a profile sealing 23, can seal the metal suitcase 1, if required.

Figure 3:
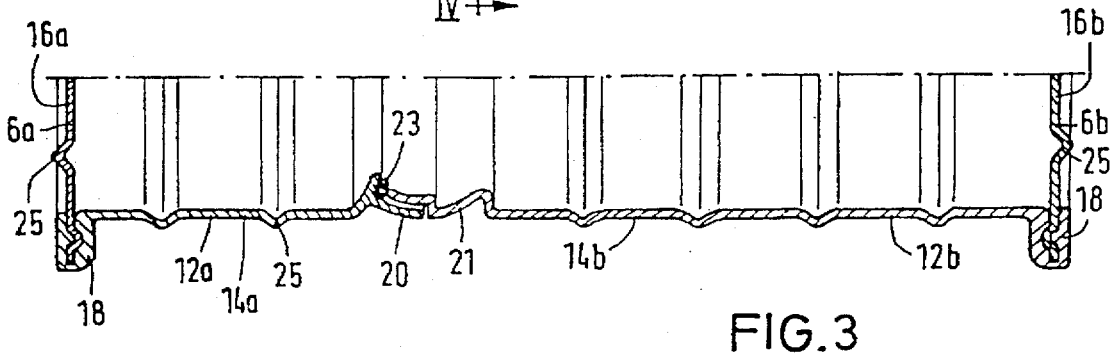
FIG. 3 is a sectional view along the line III—III in FIG. 2.

The wall-receiving profiles 18 of wall elements 14a,14b are identical, but have mirror-inverted shapes relative to each other, as best seen in FIG. 3.

The wall-receiving profile 18 projects at a right angle from the major surface of wall element 14a,14b and before assembly of the two wall elements 14,16 is spread apart in V-shape so as to be able to receive the second wall element 16a,16b. Upon assembly of the two wall elements 14a,14b, 16a,16b, the wall element receiving profiles are pressed together by plastic deformation, with the wall elements 16a,16b being held in the wall receiving profiles in positive engagement.

Figure 5:
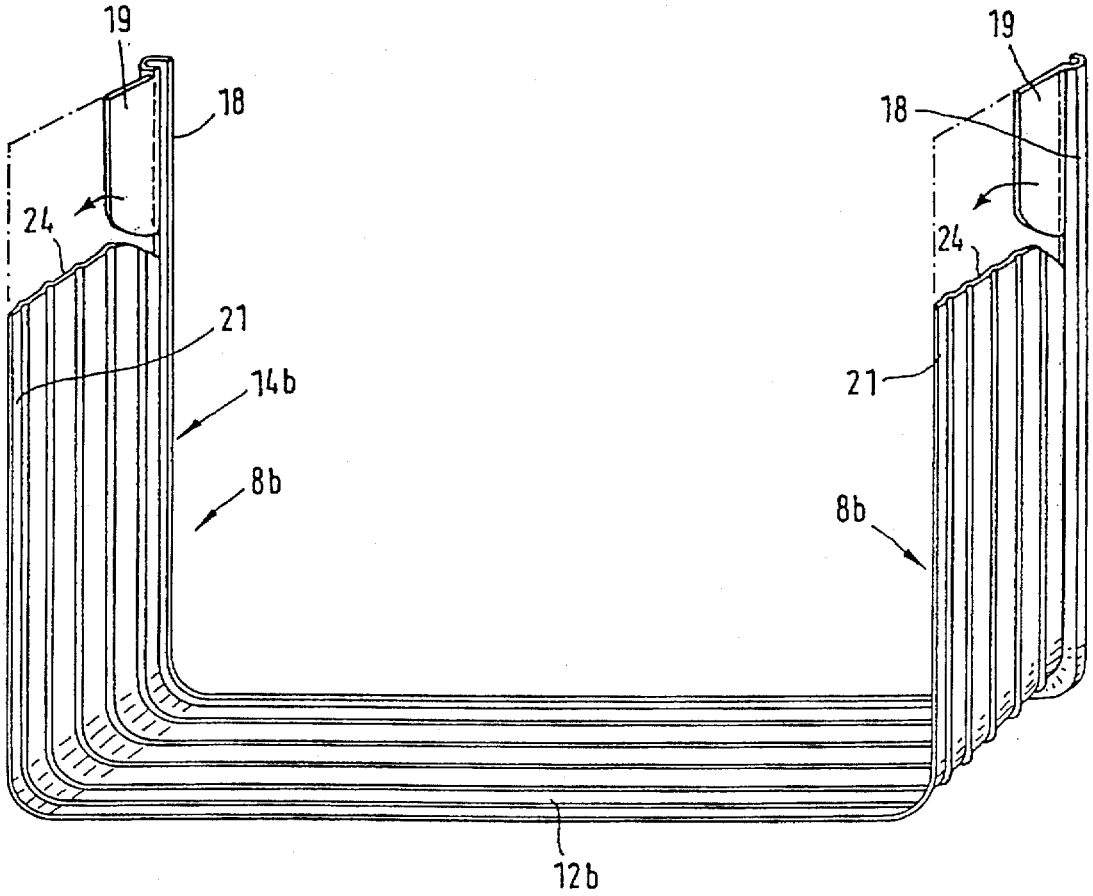
FIG. 5 is a view of a first wall element prior to assembly.

FIG. 5 illustrates the manufacture of wall element 14b from a strip-shaped metal sheet provided with profiles 25. By twice bending the metal sheet having the frame profile 21 and the wall-receiving profile 18 formed thereto, the two mutually confronting narrow sides 8b are generated in addition to the standing surface 12b. The free ends of the narrow sides 8b are punched in such a manner that the wall-receiving profile 18 projects by the width of the respective wall element 16a,16b, a flap 19 remaining on the wall-receiving profile 18 which, after bending the projecting wall-receiving profile around the end edge of the free end of the narrow sides 8b, serves for attachment to the free end of the narrow side 8b. Attachment can be performed, e.g., by riveting.

The narrow sides 8a,8b are punched in such a manner that they have a transition radius of about 2 to 8 cm, preferably about 3 to 5 cm, towards the projecting wall-receiving profile 18 so that, when being bent, the projecting wall-receiving profiles 18 can move to abut—corresponding to the transition radius —the freely terminating end edges 24 of the narrow sides 8b without being kinked.

After these manufacturing processes, there is obtained the completed first wall element 14b according FIG. 6, into the wall-receiving profile 18 of which the second wall element 16b of FIG. 7 can be inserted.

Subsequently, the wall-receiving profile 18 is pressed on by a suitable tool, providing a tight connection between the wall elements 14b and 16b.

As can be seen in FIG. 7, the second wall element 16b can have punched recesses 28 and holes 29 formed therein, designed to receive lock attachment means 30 and the handle 7, respectively.

The lock attachment means 30 can be inserted into a frame bar 32b fastened to the free edge of upper side 10b and cooperating in a mutually mating condition with a continuous frame bar 32a attached to the free end of upper side 10a. Frame bars 32a and 32b are formed by a profile being open on one side and having its longitudinal edges provided, on the one hand, with a projection and, on the other hand, with a groove, said projection being adapted to engage the groove of a corresponding profile, and the groove being preferably adapted to receive a sealing profile 35. The edges of the upper sides 10a and 10b are each connected to the frame bars 32a and 32b in that said edges, guided over the open side of the profile, enclose the frame bars 32a and 32b in positive engagement. On their end opposite the open side, the frame bars 32a,32b are each have a projection and, respectively—facing towards the groove a recess wherein the end edge of upper sides 10a,10b can be received.

The lock attachment means 30 and the frame bars 32a,32b together with the frame profile 20 and 21, respectively, form a closed frame 22 of the suitcase halves 2,4.

Figure 4:
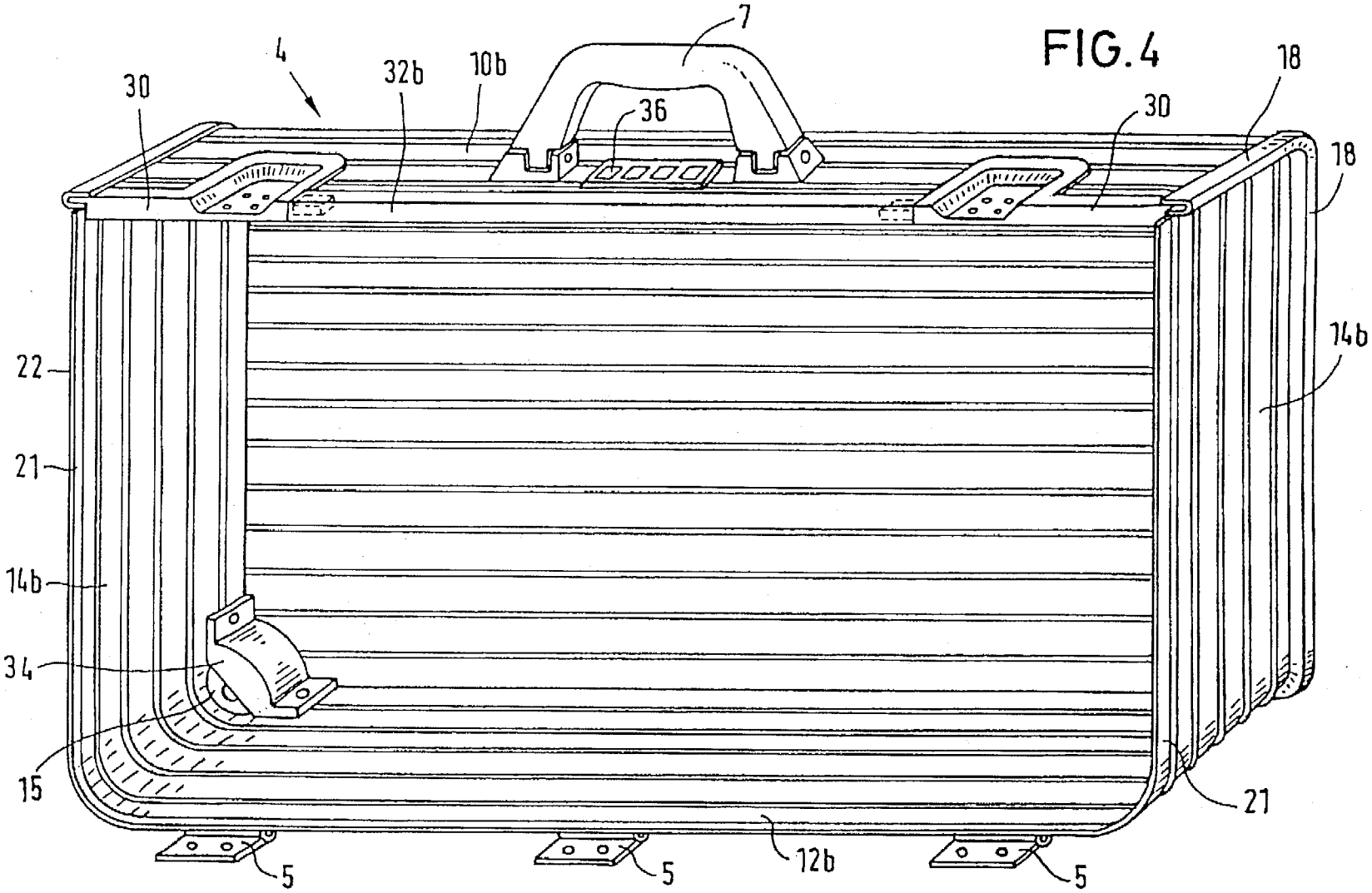
FIG. 4 is a sectional view along the line IV—IV in FIG. 2.

FIG. 4 shows the assembled suitcase half 4 with the frame profile 21 facing towards the other suitcase half, the frame profile 21 being added by the frame bar 32b and the two mirror-symmetrical lock attachment means 30 to form the closed frame 22. The first wall element 14b can have a recess formed in its lower edge wherein a roller support means 34 for one of the rollers 15 is attached. In a similar manner, also the first wall element 14a, on the side facing towards the second wall element 14a, is provided with a corresponding roller support means 34 along with a roller 15. In the embodiment according to FIG. 4, the suitcase halves 2,4 are connected to each other by three hinges 5.

The upper side 10b can be provided with a recess 36 below the handle for insertion of an inscription field or a digital lock thereinto.

The wall elements 14a,16a,16b are preferably made from a high-strength aluminium alloy.

Preferably, the first wall element 14a,14b has a larger wall thickness than the second wall element 16a,16b, and the wall thickness ratio can be between 1:1 and 1:3, preferably about 1:2.

I claim:

1. A metal suitcase (1) consisting of two suitcase halves (2, 4) comprising respectively a broad side (6a, 6b), two opposite narrow sides (8a, 8b), an upper side (10a, 10b) and a standing surface (12a, 12b), the suitcase halves (2, 4) in the closed condition engaging each other by a frame (22) extending through the narrow sides (8a, 8b), the upper side (10a, 10b) and the standing surface (12a, 12b), and the suitcase halves (2, 4) being pivotally connected to each other in the standing surface (12a, 12b), characterized in that each suitcase half (2, 4) is formed by first and second single-piece wall elements (14a, 14b, 16a, 16b), that the first wall element (14*a*, 14*b*) consists of a strip-shaped continuous-cast profile having a wall-receiving profile (18) formed to one longitudinal edge and having a frame profile (20, 21) formed to the opposite longitudinal edge that the second wall element (16*a*, 16*b*) consists of a plate-shaped metal sheet, and that the strip-shaped first wall element (14*a*, 14*b*) forms the mutually confronting narrow sides (8*a*, 8*b*) and the standing surface (12*a*, 12*b*), that the plate-shaped second wall element (16*a*, 16*b*) forms the broad side (6*a*, 6*b*) and the associated upper side (10*a*, 10*b*), and that the second wall element (16*a*, 16*b*) can be inserted in bent shape into the wall-receiving profile (18) of the first wall element (14*a*, 14*b*) and, for assembly of the respective suitcase halves (2, 4 ), can be clamped tight in the wall-receiving profile (18) of first wall element (14*a*, 14*b*).

2. The metal suitcase according to claim 1 characterized in that the wall-receiving profile (18) includes a bendable flap (19), at the respective free end of the narrow sides (8*a*, 8*b*) of the wall-receiving profile 18 with said flap (19) having a transition radius, to the end edge (24) of the narrow sides (8*a*, 8*b*).

3. The metal suitcase according to claim 1 characterized in that the broad sides (6*a*, 6*b*) merge into the upper sides (10*a*, 10*b*) with a radius of curvature of about 2 cm to about 8 cm.

4. The metal suitcase according to claim 1 characterized in that the wall-receiving profile (18) is provided with a profiled portion for clamping the second wall element (16) therein.

5. The metal suitcase according to claim 4, characterized in that the wall thickness of the first wall element (14*a*, 14*b*) is larger than the wall thickness of the second wall element (16*a*,16*b*).

6. The metal suitcase according to claim 5, characterized in that the wall thickness ratio is about 1:1 to about 1:3.

* * * * *